US010539402B2

(12) United States Patent
Anderson et al.

(10) Patent No.: US 10,539,402 B2
(45) Date of Patent: Jan. 21, 2020

(54) TARGET BRACKET

(71) Applicant: Action Target Inc., Provo, UT (US)

(72) Inventors: Devin Anderson, Santaquin, UT (US); Christopher Hess, Santaquin, UT (US)

(73) Assignee: Action Target Inc., Provo, UT (US)

( * ) Notice: Subject to any disclaimer, the term of this patent is extended or adjusted under 35 U.S.C. 154(b) by 0 days.

(21) Appl. No.: 15/884,872

(22) Filed: Jan. 31, 2018

(65) Prior Publication Data

US 2018/0209767 A1 Jul. 26, 2018

Related U.S. Application Data

(62) Division of application No. 14/996,451, filed on Jan. 15, 2016, now Pat. No. 9,927,216.

(60) Provisional application No. 62/104,541, filed on Jan. 16, 2015.

(51) Int. Cl.

| | |
|---|---|
| ***F41J 7/04*** | (2006.01) |
| *G09F 7/22* | (2006.01) |
| *G09F 15/00* | (2006.01) |
| *F41J 1/10* | (2006.01) |
| *G09F 7/18* | (2006.01) |
| *F41J 1/00* | (2006.01) |

(52) U.S. Cl.
CPC .. *F41J 7/04* (2013.01); *F41J 1/00* (2013.01); *F41J 1/10* (2013.01); *G09F 7/22* (2013.01); *G09F 15/0018* (2013.01); *G09F 2007/186* (2013.01)

(58) Field of Classification Search
CPC . F41J 7/00; F41J 1/10; F41J 7/04; F41J 7/06; G09F 7/19; G09F 7/22; G09F 2007/186; G09F 15/0018
USPC ..... 273/390–392, 406; 16/386, 262; 40/530, 40/533, 535–537, 649, 617
See application file for complete search history.

(56) References Cited

U.S. PATENT DOCUMENTS

| | | | |
|---|---|---|---|
| 157,335 | A | 12/1874 | Lyon |
| 429,942 | A | 6/1890 | McBride |
| 483,060 | A | 9/1892 | Holm |
| 570,820 | A | 11/1896 | Scratton |
| 631,175 | A | 8/1899 | Parnall |
| 840,610 | A | 1/1907 | Easdale |
| 879,670 | A | 2/1908 | Petry |
| 937,733 | A | 10/1909 | Worrell |

(Continued)

FOREIGN PATENT DOCUMENTS

| | | |
|---|---|---|
| CA | 2100631 | 2/1994 |
| GB | 2136932 | 9/1984 |
| GB | 2 187 270 | 9/1987 |

OTHER PUBLICATIONS

Caswell International Corp., Product Literature, Copyright 2002.

(Continued)

*Primary Examiner* — Mark S Graham
(74) *Attorney, Agent, or Firm* — Bateman IP; Randall B. Bateman

(57) ABSTRACT

A target system includes a blocking plate with one or more openings through which bullets are fired and one or more targets for being struck by the bullets disposed behind the blocking plate and generally in line with the one or more openings. The target system includes a slotted bracket which limits the range of movement of the target after it has been struck by a projectile. The slotted bracket also provides for tool-less attachment and removal of the targets from the blocking plate.

10 Claims, 8 Drawing Sheets

(56) References Cited

U.S. PATENT DOCUMENTS 950,101 A 2/1910 Green
960,085 A 5/1910 Giles
960,892 A 6/1910 Gates
1,025,944 A 5/1912 Elliott
1,036,879 A 8/1912 Miner
1,207,456 A 12/1916 Whelan
1,348,283 A 8/1920 Koehl
1,424,632 A 8/1922 Fenton
1,517,461 A 8/1924 Robinson
1,540,802 A 6/1925 Ordway
1,543,605 A 6/1925 Gavard
1,559,171 A 10/1925 Knowles
1,657,931 A 7/1926 Krantz
1,640,954 A 8/1927 Mach
1,738,874 A 12/1929 Domingo
1,831,289 A 11/1931 Dally
2,048,155 A 1/1935 Armantrout
2,008,359 A 7/1935 Lamb
2,039,552 A 5/1936 Reynolds
2,085,933 A 7/1937 Vaughan
2,104,171 A 1/1938 Schwerin
2,179,471 A 11/1939 Lee
2,284,510 A 5/1942 Cates
2,290,297 A 7/1942 Smith
2,344,829 A 3/1944 McAvoy
2,372,111 A 3/1945 Norberg
2,538,118 A 6/1949 Miller
2,494,210 A 1/1950 Robinson
2,535,280 A 12/1950 Gartrell
2,586,958 A 2/1952 Keller
2,587,042 A 2/1952 Haiselup
2,613,934 A 10/1952 Tabler
2,706,634 A 4/1955 Van Valkenburg
2,809,836 A 10/1957 Musser
2,819,903 A 1/1958 Saunders
2,838,309 A 6/1958 Merz et al.
2,905,469 A 9/1959 Taylor
2,957,694 A * 10/1960 Barber ..... A63F 9/0204 273/388
2,967,712 A 1/1961 Breitenfeldt
3,014,725 A 12/1961 Lewis
3,032,808 A 5/1962 Fleming
3,064,976 A 11/1962 Kuhn
3,087,701 A 4/1963 Wallace
3,103,362 A 9/1963 Elofson
3,113,773 A 12/1963 Ripepe
3,140,874 A 7/1964 Jensen et al.
3,233,904 A 2/1966 Gillam et al.
3,348,843 A 10/1967 Stanley
3,363,900 A 1/1968 Cadle
3,385,405 A 5/1968 Cullen
3,392,980 A 7/1968 Ortega
3,422,538 A 1/1969 Panissidi
3,471,153 A 10/1969 Baumler
3,510,133 A 5/1970 Gretzky
3,515,388 A 6/1970 Zachmeier
3,540,729 A 11/1970 Rahberger
3,601,353 A 8/1971 Dale
3,614,102 A 10/1971 Nikoden, Sr.
3,638,894 A 2/1972 Leutenegger
3,720,411 A 3/1973 Vogelaere
3,755,942 A 9/1973 Samsing
3,802,098 A 4/1974 Sampson et al.
3,814,429 A * 6/1974 Lienhard ..... A63B 63/06 273/127 D
3,914,879 A 10/1975 Taylor, III
3,992,007 A 11/1976 Seeman
4,072,313 A 2/1978 Murso et al.
4,076,247 A 2/1978 Kim et al.
4,084,299 A 4/1978 Noda
4,086,711 A 5/1978 Gammarino et al.
4,177,835 A 12/1979 Paley
4,205,847 A 6/1980 Steiger et al.
4,228,569 A 10/1980 Snyder
4,232,867 A 11/1980 Tate, Sr.
4,249,743 A * 2/1981 Lee ..... F41J 7/04 273/391
4,288,080 A 9/1981 Laporte et al.
4,294,452 A 10/1981 Schlotter et al.
4,340,370 A 7/1982 Marshall et al.
4,361,330 A 11/1982 Scharer
4,395,045 A 7/1983 Baer
4,440,399 A 4/1984 Smith
4,501,427 A 2/1985 Payne
4,506,416 A 3/1985 Ohminato et al.
4,540,182 A 9/1985 Clement
4,546,984 A 10/1985 Towle et al.
4,603,452 A * 8/1986 Paciorek ..... E05D 7/10 16/262
4,614,345 A 9/1986 Doughty
4,657,261 A 4/1987 Saunders
4,691,925 A 9/1987 Scholem
4,706,963 A 11/1987 Geuss
4,726,593 A 2/1988 Wade
4,739,996 A 4/1988 Vedder
4,743,032 A 5/1988 Summers et al.
4,807,888 A 2/1989 Pidde
4,844,476 A 7/1989 Becker
4,890,847 A 1/1990 Cartee et al.
4,898,391 A 2/1990 Kelly et al.
4,911,453 A 3/1990 Essex et al.
4,913,389 A 4/1990 McCracken
4,953,875 A 9/1990 Sudit
4,979,752 A 12/1990 Fosseen
5,054,723 A 10/1991 Arnold
5,145,133 A 9/1992 France
5,163,689 A 11/1992 Bateman
5,213,336 A 5/1993 Bateman
5,232,227 A 8/1993 Bateman
5,240,258 A 8/1993 Bateman
5,242,172 A 9/1993 Bateman
5,257,790 A * 11/1993 Meadows ..... F41J 7/04 273/389
5,263,721 A 11/1993 Lowrance
5,277,432 A 1/1994 Bateman
5,316,479 A 5/1994 Wong et al.
5,324,043 A 6/1994 Estrella
5,346,226 A 9/1994 Block
5,350,180 A 9/1994 Acock
5,352,170 A 10/1994 Condo et al.
5,361,455 A 11/1994 Kiefer
5,400,692 A 3/1995 Bateman
5,433,451 A 7/1995 De Vries
5,535,662 A 7/1996 Bateman
5,598,996 A 2/1997 Rath
5,605,335 A 2/1997 Simpson
5,618,044 A 4/1997 Bateman
5,621,950 A 4/1997 White
5,636,995 A 6/1997 Sharpe, III et al.
5,641,288 A 6/1997 Zaenglein, Jr.
5,648,794 A 7/1997 Jelsma et al.
5,649,706 A 7/1997 Treat, Jr. et al.
5,676,378 A 10/1997 West
5,695,196 A 12/1997 Yanosky
5,765,832 A 6/1998 Huff
5,802,460 A 9/1998 Parvulescu et al.
5,811,718 A 9/1998 Bateman
5,822,936 A 10/1998 Bateman
5,829,753 A 11/1998 Wiser
5,865,439 A 2/1999 Marcuson
5,906,552 A 5/1999 Padilla
5,907,930 A 6/1999 Ricco
5,934,678 A 8/1999 Theissen et al.
5,947,477 A 9/1999 Turnipseed
5,950,283 A 9/1999 Sato
5,951,016 A 9/1999 Bateman
5,963,624 A 10/1999 Pope
5,967,523 A 10/1999 Brownlee
5,988,645 A 11/1999 Downing
6,018,847 A 2/2000 Lu
6,109,614 A 8/2000 Ciarcia
6,223,029 B1 4/2001 Stenman et al.
6,230,214 B1 5/2001 Liukkonen et al.
6,283,756 B1 9/2001 Danckwerth et al.

(56) References Cited

U.S. PATENT DOCUMENTS 6,289,213 B1 9/2001 Flint et al.
6,308,062 B1 10/2001 Chien et al.
6,311,980 B1 11/2001 Sovine et al.
6,322,444 B1 11/2001 Matsui et al.
6,325,376 B1 12/2001 Elliott et al.
6,328,651 B1 12/2001 Lebensfeld et al.
6,332,243 B1 12/2001 Kim
6,378,870 B1 4/2002 Sovine
6,398,215 B1 6/2002 Carroll
6,463,299 B1 10/2002 Macor
6,478,301 B1 11/2002 Witmeyer
6,484,990 B1 11/2002 Marshall
6,502,820 B2 1/2003 Slifko
6,533,280 B1 3/2003 Sovine et al.
6,543,778 B2 4/2003 Baker
6,575,753 B2 6/2003 Rosa et al.
6,588,759 B1 7/2003 Bateman
6,679,795 B2 1/2004 Ouimette et al.
6,718,596 B2 4/2004 Kohlstrand et al.
6,728,546 B1 4/2004 Peterson et al.
RE38,540 E 6/2004 Bateman
6,761,357 B2 6/2004 Witt
6,776,418 B1 8/2004 Sovine et al.
6,808,177 B2 10/2004 Dehart
6,808,178 B1 10/2004 Sovine
6,896,267 B1 5/2005 Le Anna
6,975,859 B1 12/2005 Lambert et al.
6,994,347 B2 2/2006 Tessel et al.
6,994,348 B2 2/2006 Lambert et al.
6,994,349 B2 2/2006 Lambert et al.
7,128,321 B1 * 10/2006 Brown ..... F41J 5/18 273/392
7,134,977 B2 11/2006 Campbell et al.
7,140,615 B1 11/2006 Sovine et al.
7,175,181 B1 2/2007 Bateman et al.
7,194,944 B2 3/2007 Lambert et al.
7,201,376 B2 4/2007 Kuosa
7,219,897 B2 5/2007 Sovine et al.
7,234,890 B1 6/2007 Marshall et al.
7,264,246 B2 9/2007 Sovine et al.
7,275,748 B2 10/2007 Lambert et al.
7,302,768 B2 12/2007 Gajdacs
7,303,192 B2 12/2007 Marshall et al.
7,306,230 B2 12/2007 Lambert et al.
7,322,771 B1 1/2008 Marshall et al.
7,427,069 B2 9/2008 Bateman et al.
7,431,302 B2 10/2008 Bassett et al.
7,469,903 B2 12/2008 Marshall et al.
7,497,441 B2 3/2009 Marshall et al.
7,503,250 B2 3/2009 Lambert et al.
7,556,268 B2 7/2009 Bateman et al.
7,653,979 B2 2/2010 Bateman et al.
7,775,526 B1 8/2010 Lambert et al.
7,793,937 B2 9/2010 Bateman et al.
7,815,192 B1 10/2010 Kreiman et al.
7,914,004 B2 3/2011 Wright et al.
7,950,666 B2 5/2011 Stincelli et al.
8,016,291 B2 9/2011 Wright et al.
8,091,896 B2 1/2012 Lambert et al.
8,128,094 B2 3/2012 Lambert et al.
8,162,319 B2 4/2012 Stincelli et al.
8,276,916 B2 10/2012 Bateman et al.
8,469,364 B2 6/2013 Bassett et al.
8,485,529 B2 7/2013 Bateman et al.
8,550,465 B2 10/2013 Wright et al.
8,579,294 B2 11/2013 Wright et al.
8,684,361 B2 4/2014 Henson et al.
8,713,829 B1 5/2014 Crofford
8,813,401 B2 8/2014 Diercks
8,827,273 B2 9/2014 John et al.
9,217,623 B2 12/2015 Sovine et al.
9,228,810 B2 1/2016 Bareman et al.
9,574,855 B2 * 2/2017 Davis ..... F41J 5/205
9,927,216 B2 3/2018 Anderson et al.
2005/0001381 A1 1/2005 Lambert et al.
2005/0022658 A1 2/2005 Bateman
2005/0034594 A1 2/2005 Parks et al.
2006/0107985 A1 5/2006 Sovine
2006/0234069 A1 10/2006 Sovine et al.
2006/0240388 A1 10/2006 Marshall et al.
2006/0240391 A1 10/2006 Sovine et al.
2006/0290063 A1 12/2006 Hagar
2006/0290064 A1 12/2006 Hagar
2007/0072537 A1 3/2007 Bateman et al.
2007/0102883 A1 5/2007 Parks et al.
2008/0185786 A1 8/2008 Loveland et al.
2008/0277876 A1 * 11/2008 Riley ..... F41J 7/04 273/388
2009/0014961 A1 1/2009 Bateman et al.
2009/0179382 A1 * 7/2009 Stincelli ..... F41J 7/04 273/392
2009/0206551 A1 8/2009 Parks et al.
2010/0311015 A1 12/2010 Sovine et al.
2011/0233869 A1 9/2011 John et al.
2012/0187631 A1 7/2012 John et al.
2012/0193872 A1 8/2012 Henson et al.
2012/0247314 A1 10/2012 Bassett et al.
2012/0274028 A1 11/2012 Sudbeck et al.
2013/0106059 A1 5/2013 Larue
2013/0207347 A1 8/2013 Sovine et al.
2015/0260486 A1 9/2015 Trimbath
2015/0276356 A1 10/2015 Cesternino
2015/0292842 A1 10/2015 Pixton
2015/0330747 A1 11/2015 Ferrell

OTHER PUBLICATIONS

Duelatron, Product Literature 1995.
Law Enforcement Targets, Inc., Product Literature, Jul. 8, 2003.
Law Enforcement Targets, Inc., Product Literature, Oct. 12, 2004.
Law Enforcement Targets, Inc., Product Literature, Jun. 26, 2007.
Metal Spinning Target, Inc., Dueling Trees, Jul. 8, 2003.
Mike Gibson Manufacturing, Dueling Tree, Jul. 8, 2003.
Outwest MFG. Products, Product Literature, Jul. 8, 2003.
Porta Target, Product Literature, Circa 2000.
Shootrite, Tactical Training Target, published prior to Apr. 4, 2005.

* cited by examiner

TARGET BRACKET

BACKGROUND

State of the Art

The present invention relates to targets used for target practice. More specifically, the present invention relates to target systems which can be readily modified to facilitate different target training exercises, and to facilitate the adjustment or replacement of bullet-deflecting targets on the target system.

Field of Art

In order to maintain proficiency in the use of firearms, it is common for law enforcement officers, members of the military, and sportsmen to engage in target practice. While many perceive target practice as simply a method for improving accuracy, it is important for law enforcement officers and the like to conduct target practice in scenarios which improve timing and the ability to make split-second decisions on whether or not to fire. Such split-second decisions can mean the difference between life and death both for the officer and the potential threat.

In order to properly train police officers, it is important that they develop both hand-eye coordination and that they receive sensor stimulation which is associated with actual conditions. Thus, it is important for law enforcement officers to be able to see when a target has been hit. It is also important that the target remain upright sufficiently to simulate the reactions of a typical target. Thus, for example, a target which falls when hit by a single shot may not provide appropriate stimulus to the officer, when a typical perpetrator would take several rounds before being sufficiently incapacitated that he or she would no longer pose a threat.

It is also important to train officers by requiring them to repeatedly be in situations in which they are forced to decide whether the target poses a threat within a fraction of a second. In real life situations, hesitating to fire can cost the officer his life. Firing too quickly can result in the death of an innocent party.

One common type of target is a pop-up target. A pop-up target is typically disposed behind a shield and includes a target which can be made to stand generally vertical. When the target is hit by a bullet, the target will fall over, thereby providing a visual stimulus that the target has been hit. An arm often engages the target and lifts it back into a vertical position to allow further shooting. Other targets may use a spring to draw the target back to the upright position.

Another type of target is a shoot-through target which has distinctive "kill zones." Such a target may provide a silhouette of a person or representation of a person similar to an IDPA (International Defensive Pistol Association) target or an FBI-Q training target and have cut-outs in areas where a hit would most likely be fatal (typically the areas associated with the head and parts of the chest). The officer often will not be able to advance until the target has been hit in the kill zone. Thus, the officer is placed under stress until he or she has properly hit the target in such a way that a real person would be incapacitated if so hit.

A third type of target includes a blocking plate which may be positioned in a forward position to present a general target area for a shooter. One or more openings are formed in the blocking plate in areas where it may be desirable for the shooter to hit. At least one target is placed behind the opening(s) in the blocking plate. The target is movable when struck by a bullet to provide a visual indication that the target has been hit by the shooter. In such a manner, the shooter is provided with an immediate indication as to whether the shot was successful. An advantage of such a system is that the target may be attached to the blocking plate by a hinge-and-pin mechanism, and the hinge-and-pin mechanism allows the target to be attached to and removed from the blocking plate without the use of tools. However, over time, the pin may become bent, preventing the target from being easily removed from the blocking plate.

In such a system, the target is also subject to repeated jolting from impact with bullets. When these impacts occur rapidly, the target may 'shimmy' up through the hinge-and-pin mechanism, and eventually could fall off the blocking plate. Such an event prevents the target from being used, and could require a stop to shooting practice while an individual walks downrange to replace the target on the blocking plate frame.

Further, in order to maximize the benefit of training, it is often desirable to change the targets between each exercise. This prevents the officer from getting accustomed to the target layout, color combinations (e.g. a scenario in which the officer is only to shoot at green targets) and anticipating what will be presented. However, with many existing target designs, changing the targets can be time consuming and burdensome.

Additionally, shooting ranges spend a great deal of time and money on replacing both targets and the devices to which they are mounted as both become damaged. When targets are made of lightweight material, such as cardboard, they are easier to replace, but do not last long. Additionally, bullets travel readily through a cardboard target, and must be stopped by other features of the shooting range, such as dirt berms or bullet containment traps. When targets are made of metal instead, they can be unwieldy and difficult to replace in most systems. Some types of target systems, if the target is made of less penetrable material, can also risk deflecting a bullet back at the shooter. Finally, many types of bullet target systems cannot adequately work with large-dimension targets, such as the standard International Defensive Pistol Association (IDPA) official target, which measures 18 and ¼ inches by 30 and ¾ inches; or the United States Practical Shooting Association (USPSA) official target, which measures 18 and ¼ inches by 30 and ⅛ inches.

While there are high-tech shooting ranges which are configured to place an officer in a variety of situations, such shooting ranges are too expensive for many law enforcement agencies. Thus, there is a need for simple bullet targets which provide improved situation stimulus, improved wear particularly when subject to constant fire, more efficient replacement of the targets when they become worn, improved bullet deflection and collection, and compatibility with standard target shapes.

SUMMARY OF THE INVENTION

The following summary of the present invention is not intended to describe each illustrated embodiment or every possible implementation of the invention, but rather to give illustrative examples of application of principles of the invention.

In some configurations, the invention may comprise a blocking plate. One or more openings may be formed in the blocking plate in areas where it may be desirable for the shooter to hit. At least one target may be placed behind the opening(s) in the blocking plate. The target may be movable when struck by a bullet to provide a visual indication that the target has been hit by the shooter. In such a manner, the shooter is provided with an immediate indication as to whether the shot was successful. The target may be slideably attached to the blocking plate by means of locking tabs, which fit into two slotted brackets affixed to the back of the blocking plate.

In accordance with one aspect of the present disclosure, the slotted brackets may be equipped with a rotational portion which is smoothly curved, to permit the target to swing when struck, thereby providing visual indication of a hit to the shooter.

In accordance with one aspect of the disclosure, the slotted brackets may be equipped with an angular retaining projection.

In accordance with another aspect of the disclosure, the slotted brackets may be equipped with an angular entry projection.

In accordance with one aspect of the disclosure, the slotted brackets may be equipped with a curved entry projection.

In accordance with still yet another aspect of the disclosure, the blocking plate is positioned vertically.

In accordance with still another aspect of the disclosure, the blocking plate may be positioned in a forward-tilting position. In some embodiments, the size of one or more openings in the blocking plate is adjusted so that, even though the blocking plate is forward-tilting, the openings still present target areas of appropriate regulation size.

In accordance with still another aspect of the disclosure, the slotted brackets may be immovably attached to the blocking plate.

In accordance with still another aspect of the disclosure, the thickness of the target does not vary.

In accordance with another aspect of the disclosure, a substantial portion of the target may be wider than the spacing between the slotted brackets. The target between the brackets is narrower than the spacing of the slotted brackets (omitting the tabs).

These and other aspects of the present invention are realized in a target system as shown and described in the following figures and related description. It will be appreciated that various embodiments of the invention may not include each aspect set forth above and aspects discussed above shall not be read into the claims unless specifically described therein.

BRIEF DESCRIPTION OF THE DRAWINGS

Various embodiments of the present disclosure are shown and described in reference to the numbered drawings wherein.

Figure 1:
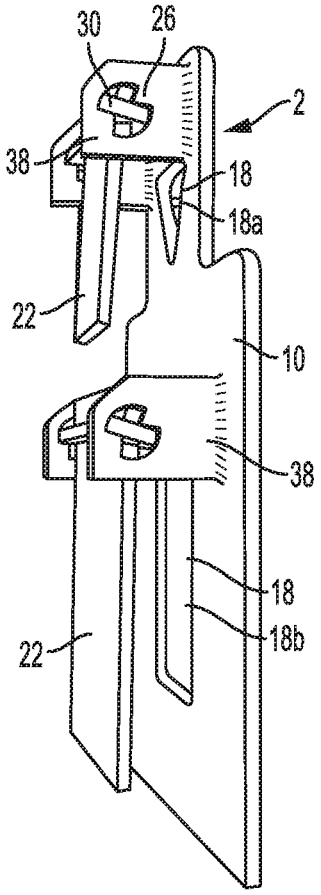
FIG. 1 PRIOR ART
FIG. 1 illustrates a conventional hinge-and-pin target made in accordance with the teachings of the prior art.

It will be appreciated that the drawings are illustrative and not limiting of the scope of the invention which is defined by the appended claims. The embodiments shown accomplish various aspects and objects of the invention. It will be appreciated that it is not possible to clearly show each element and aspect of the present disclosure in a single figure, and as such, multiple figures are presented to separately illustrate the various details of different aspects of the invention in greater clarity. Similarly, not all configurations or embodiments described herein or covered by the appended claims will include all of the aspects of the present disclosure as discussed above.

DETAILED DESCRIPTION

Various aspects of the invention and accompanying drawings will now be discussed in reference to the numerals provided therein so as to enable one skilled in the art to practice the present invention. The skilled artisan will understand, however, that the methods described below can be practiced without employing these specific details, or that they can be used for purposes other than those described herein. Indeed, they can be modified and can be used in conjunction with products and techniques known to those of skill in the art in light of the present disclosure. The drawings and the descriptions thereof are intended to be exemplary of various aspects of the invention and are not intended to narrow the scope of the appended claims. Furthermore, it will be appreciated that the drawings may show aspects of the invention in isolation and the elements in one figure may be used in conjunction with elements shown in other figures.

Reference in the specification to "one embodiment," "one configuration," "an embodiment," or "a configuration" means that a particular feature, structure, or characteristic described in connection with the embodiment may be included in at least one embodiment, etc. The appearances of the phrase "in one embodiment" in various places may not necessarily limit the inclusion of a particular element of the invention to a single embodiment, rather the element may be included in other or all embodiments discussed herein.

Furthermore, the described features, structures, or characteristics of embodiments of the present disclosure may be combined in any suitable manner in one or more embodiments. In the following description, numerous specific details may be provided, such as examples of products or manufacturing techniques that may be used, to provide a thorough understanding of embodiments of the invention. One skilled in the relevant art will recognize, however, that embodiments discussed in the disclosure may be practiced without one or more of the specific details, or with other methods, components, materials, and so forth. In other instances, well-known structures, materials, or operations may not be shown or described in detail to avoid obscuring aspects of the invention.

Before the present invention is disclosed and described in detail, it should be understood that the present invention is not limited to any particular structures, process steps, or materials discussed or disclosed herein, but is extended to include equivalents thereof as would be recognized by those of ordinarily skill in the relevant art. More specifically, the invention is defined by the terms set forth in the claims. It should also be understood that terminology contained herein is used for the purpose of describing particular aspects of the invention only and is not intended to limit the invention to the aspects or embodiments shown unless expressly indicated as such. Likewise, the discussion of any particular aspect of the invention is not to be understood as a requirement that such aspect is required to be present apart from an express inclusion of that aspect in the claims.

It should also be noted that, as used in this specification and the appended claims, singular forms such as "a," "an," and "the" may include the plural unless the context clearly dictates otherwise. Thus, for example, reference to "a bracket" may include an embodiment having one or more of such brackets, and reference to "the target plate" may include reference to one or more of such target plates.

As used herein, the term "substantially" refers to the complete or nearly complete extent or degree of an action, characteristic, property, state, structure, item, or result to function as indicated. For example, an object that is "substantially" enclosed would mean that the object is either completely enclosed or nearly completely enclosed. The exact allowable degree of deviation from absolute completeness may in some cases depend on the specific context, such that enclosing the nearly all of the length of a lumen would be substantially enclosed, even if the distal end of the structure enclosing the lumen had a slit or channel formed along a portion thereof. The use of "substantially" is equally applicable when used in a negative connotation to refer to the complete or near complete lack of an action, characteristic, property, state, structure, item, or result. For example, structure which is "substantially free of" a bottom would either completely lack a bottom or so nearly completely lack a bottom that the effect would be effectively the same as if it completely lacked a bottom.

As used herein, the term "about" is used to provide flexibility to a numerical range endpoint by providing that a given value may be "a little above" or "a little below" the endpoint while still accomplishing the function associated with the range.

As used herein, a plurality of items, structural elements, compositional elements, and/or materials may be presented in a common list for convenience. However, these lists should be construed as though each member of the list is individually identified as a separate and unique member.

Concentrations, amounts, proportions and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

Figure 2:
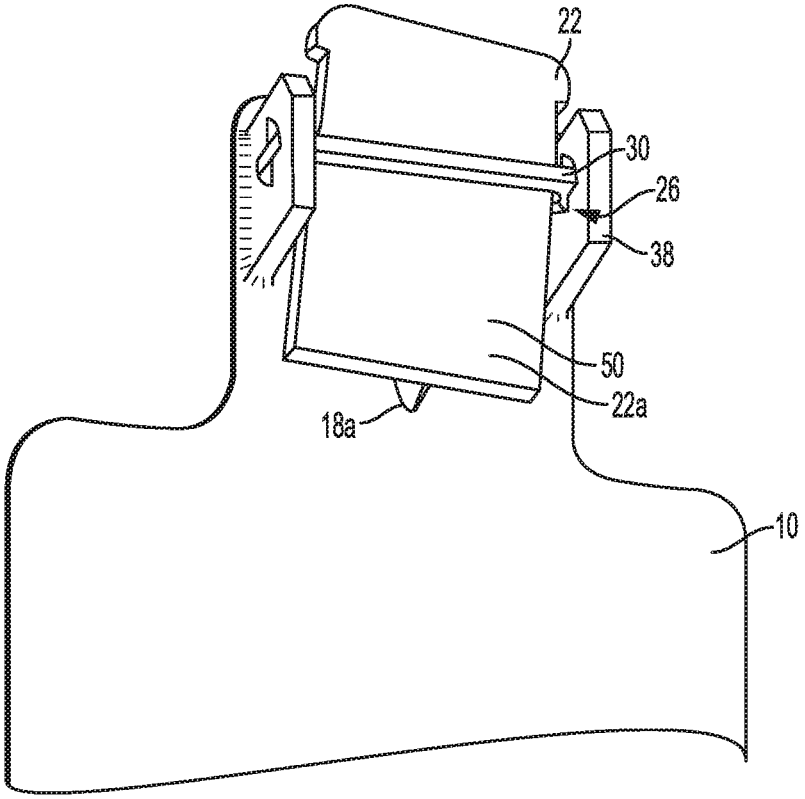
FIG. 2 PRIOR ART
FIG. 2 shows a close-up view of the pin/target engagement of the prior art device of FIG. 1.

Turning now to FIGS. 1 and 2, there are shown a side perspective view and a close-up rear view of a target system of the prior art (U.S. Pat. No. 8,684,361) generally indicated at 2. The target system 2 includes a blocking plate 10 and a plurality of openings 18*a*, 18*b* associated with desired kill zones. Behind each opening, there may be a target 22. The targets 22 may be formed by pieces of metal (often steel), wood, plastics, or other appropriate target material depending on the projectiles being used.

In order to form a hinge so that the target 22 can swing when struck with a bullet, the target system 2 is equipped with a rectangular hinge pin 30 having a slot for receiving the target as shown in FIG. 2. The targets 22 are held in place by the hinge pin 30 and by hinge holes 26 in hinge mounts 38 extending from the blocking plate 10. In order to hang the targets 22 in place, the hinge pin 30 is fed through the hinge holes 26, so that the hinge pin 30 is supported by the hinge mounts 38, and the target is fed down into the hinge pin 30.

Because the target 22 cannot be allowed to slip entirely through the hinge pin 30, some part of the target 22 must be either wider than, thicker than, or bent over the rectangular pin 30. Because the target 22 must fit between the hinge mounts 38 and extend through the rectangular pin 30, a substantial portion of the target 22 is narrower than the spacing between the hinge mounts 38.

Removing a target 22 completely from the prior art target system 2 therefore requires two motions—one to lift the target 22 and one to slide the hinge pin 30 from the hinge holes 26. If the hinge pin 30 is bent, placing or removing a target 22 can be difficult. Further, when bullets rapidly pass through the holes 18 in the blocking plate 10, the target 22 may be jolted and may shimmy or otherwise move upwardly, until the target falls out of the target system 2. In some situations the entire target 22 can be ejected by a single high powered round.

Figure 3:
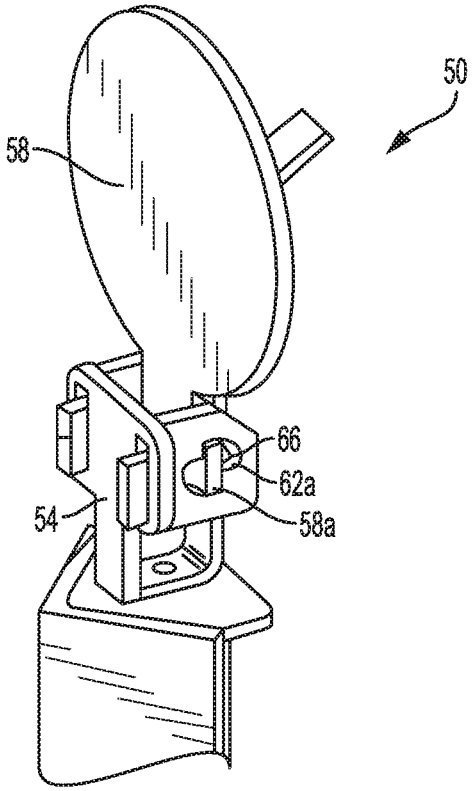
FIG. 3 PRIOR ART
FIG. 3 shown an alternate construction of a hinged target of the prior art.

FIG. 3 shows an alternate target system, generally indicated at 50, in which the target plate 58 is simple a knock down target relative to the base 54 (such as shown in U.S. Pat. No. 6,776,418). The target 58 includes tabs 58*a* which can rotate in holes 66 formed in brackets 62, with the rotation being limited by a surface 62*a* defining a portion of the hole. The brackets may be removably mountable in a base 54 such that sliding the brackets upwardly releases the brackets and enables the target plate 58 to be removed.

Figure 4:
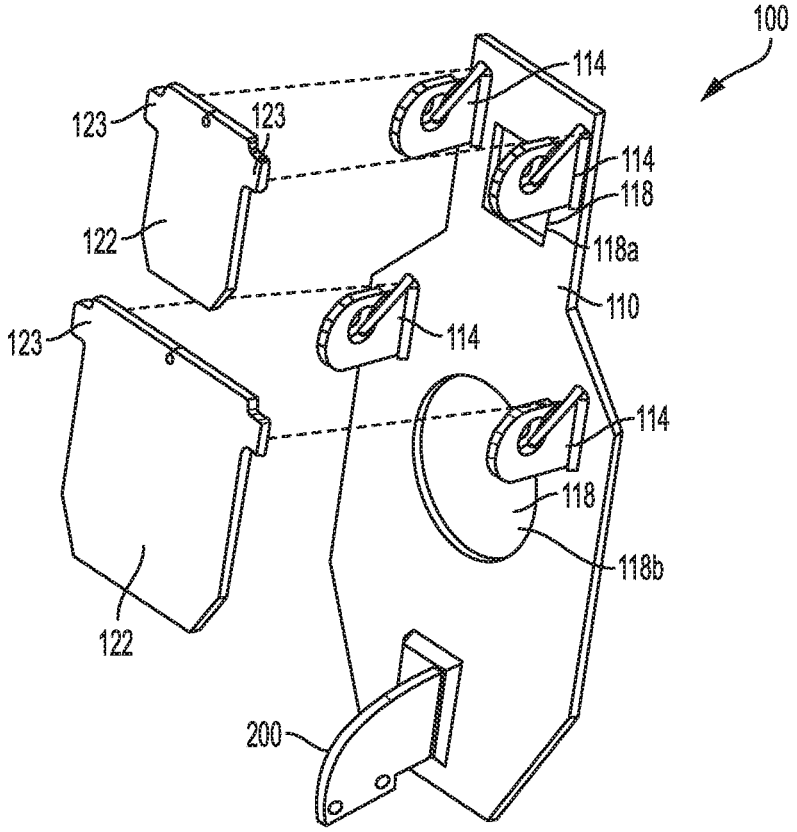
FIG. 4 illustrates a rear view of a target system in accordance with the present disclosure.

Turning now to FIG. 4, there is shown an overhead view of one configuration of a target system, generally indicated at 100, made in accordance with the teachings of the present disclosure. The target system may be held upright by, for example, target stand 200. The target stand 200 may hold the target system at an angle perpendicular to the ground, or at an angle leaning towards the shooter, so that bullets which deflect from the target system will deflect towards the ground and not towards other shooters. The target stand 200 may be, for example, bolted to the floor or to some other support structure. It will be appreciated that the target stand 200 need not be a projection, but could be, for example, a weighted ledge, clamps, or any other means of keeping the target system 100 from being knocked down or moved when struck with a bullet.

The target system 100 includes a blocking plate 110 which provides a first target area. The target system 100 may include a plurality of openings 118 (upper 118*a* and lower 118*b*) in the blocking plate 110 through which projectiles may pass to strike targets 122 positioned behind the blocking plate 110. Attached to the blocking plate 110 may be a plurality of slotted brackets 114 positioned adjacent to the openings 118. As shown in FIG. 4, four slotted brackets 114 are present, but it will be appreciated that one bracket 114, for example, could be used with a target 122 having a correspondingly-shaped fastener, or just two slotted brackets 114 on which a large target plate 122 could hang and thereby cover a plurality of openings 118, and so on.

Figure 7:
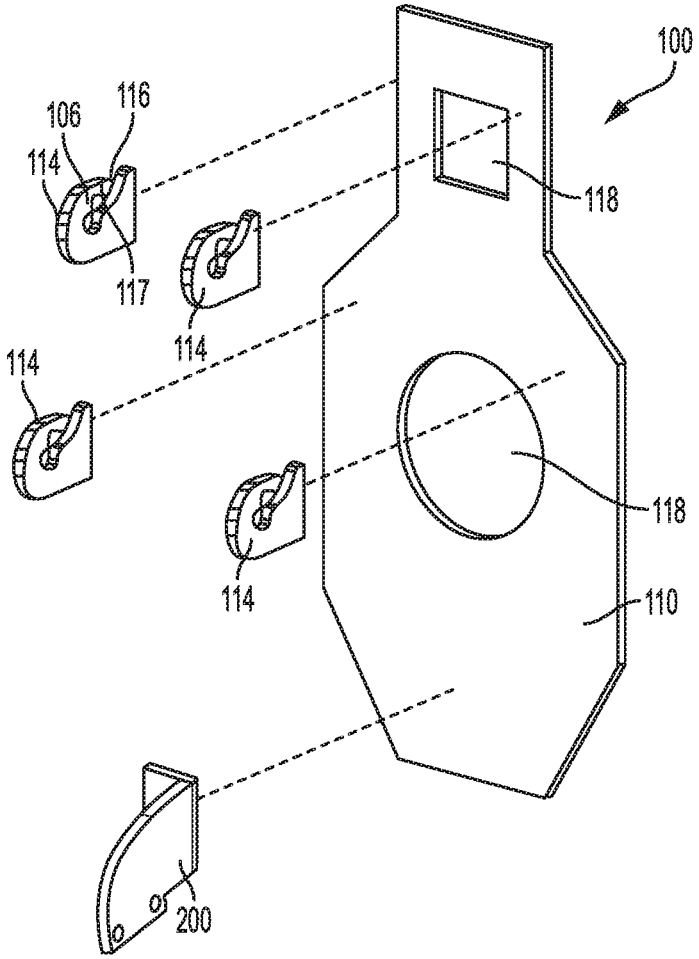
FIG. 7 illustrates a rear exploded view of the target system, including the placement of the slotted hinges and a bolted stand as means of keeping the target system standing at a desired angle.

As also shown in FIG. 7, the slotted brackets 114 may be attached to (by welding or other means) the blocking plate 110. In the alternative, the slotted brackets 114 may be formed integrally with the blocking plate 110, such as by extensions being left when cutting the blocking plate 110 and then being bent rearwardly to form the slotted brackets 114. While shown as being attached to the blocking plate 110, it will be appreciated that a support frame or other structure could also be used to hold the slotted brackets 114 and targets 122 behind the blocking plate 110 without the slotted brackets 114 having to be attached thereto. The blocking plate 110 could also be attached to a common support frame as the slotted brackets 114 to hold all of the parts in relative proximity to one another.

The blocking plate 110 may be of any particular shape. However, it may be preferred to have the blocking plate 110 to have a generally similar shape as the expected real life target associated with a particular tactical situation. Thus, as shown in FIG. 4, the blocking plate 110 is in the general silhouette of a person. However, other blocking plate shapes could be used. For example, if training to disable a vehicle, a blocking plate may be in the shape of a vehicle. If being used to train for hunting, the blocking plate may be generally in the shape of an animal.

The blocking plate 110 may include one or more openings 118 through which a bullet or other projectile can pass. As shown in FIG. 4, a first opening 118*a* is positioned to correlate with a person's head. This area, often referred to generally as a "kill zone," correlates to an area which an officer should shoot when trying to kill a perpetrator who is posing an imminent threat to the officer or other member of the public. A shot to the head will usually be disabling and, at a minimum, prevent the shooter from being able to threaten or injure the officer or third parties.

The second opening 118*b* is positioned at another kill zone, the area immediately around the heart. A perpetrator hit in the proper place in the chest will usually be killed or incapacitated. Thus, an officer engaging in target practice can shoot at the two kill zones on a target to ensure that he or she is able to take down a threat before the threat can injure the officer or others.

It will be appreciated that target openings on other targets may have different shapes or may be positioned in different locations relative to a blocking plate. For example, an infantryman in the army may train to disable a vehicle with his weapon. The blocking plate 110 may be in the shape of a truck and the openings 118 may correlate with the likely location of the driver's head, the gas tank or other locations in which the soldier should shoot. Likewise, if used for practice hunting, the blocking plate 110 may be in the form of an animal and the openings 118 placed in appropriate locations for the animal (typically the head and heart).

Disposed behind the openings 118 may be targets 122 which are to be hit by the shooter. The targets 122 may typically be steel plates or may be comprised of some other similar or suitable material to be impacted by the bullet. The targets 122 may have different mass to thereby allow the target 122 to move appropriately in response to a given class of projectile, while minimizing damage to the target 122. Thus, for example, the target 122 may be made from one-quarter inch soft steel for being shot with a twenty-two caliber pistol, and be replaced with a one-half inch piece of hardened steel for being shot by a high powered rifle. If it is desirable to know the precise point at which a bullet impacted the target 122, then a penetrable target material can be used, such as plastic or wood.

While the target 122 is shown as being narrower than the distance between the brackets (excepting the tabs 123), one advantage of the present disclosure may be that a substantial portion of the target 122 can be wider than the slotted brackets 114. So long as the a portion of the target 122 adjacent the tabs 123 is narrow enough to accommodate insertion and removal of the tabs from the slotted brackets 114, the remainder of the target 122 may be substantially wider than the distance between the brackets.

One important aspect of a target system 100 such as that shown in FIG. 4 is the ability to change out the targets 122. While marksmanship is important, it is also desirable to require the officer, etc., to be forced to adapt to different situations and make split second decisions regarding whether or not to fire. If the same targets 122 are presented every time, the officer can anticipate how he or she is supposed to react to a given target, thereby allowing him or her to pre-decide the appropriate reaction (i.e. whether to fire and where to fire). Thus, it is desirable to routinely change the targets 122 so that the officer, etc., must make decisions when the target is presented. Targets with different colors or other visual identifiers may be used to indicate whether the officer, etc., should or should not shoot. Thus, for example, ten target systems 100 may be aligned in a row. The first, fourth, sixth and tenth target system have red targets and the remaining target systems have blue targets. The officer is then told to proceed until he has killed all of the red targets. Once the sequence is completed, the targets can be changed around so that officer is not able to anticipate in advance which targets are to be shot.

Additionally, it may also be desirable to change targets 122 in response to different types of ammunition being fired. For example, when firing a high powered rifle, it may be desirable to have a heavy plate of hardened steel as the target 122 to minimize damage caused to the plate. However, if the shooter is firing a .22 caliber pistol, a very heavy plate will move little in response to the impact, thereby minimizing the ability of the shooter to confirm that he or she has hit the proper location. Thus, it is desirable to be able to change out the targets 122 so that the target will respond appropriately when a particular caliber of bullet strikes the target. The present invention allows such changes to be made with very little effort and avoids the need for tools altogether.

The present disclosure may also allow the degree of rotation to be selected. For example, the target may be allowed to rotate between approximately 60 and 80 degrees from its starting point, and in some embodiments about 70 degrees. Where the blocking plate 110 and the target 122 are initially disposed at an angle of about 15 degrees less than vertical toward the shooter, it may be desirable for the target to be limited to about 70 degrees, so that the target will only rotate 85 degrees from vertical, thus ensuring that the target continually deflects projectiles downwardly. If the target where disposed more vertically, a larger amount of rotation could be used.

The targets 122 further may include tabs, 123, adapted to slide into the slotted brackets 114. When the target 122 is hit, it will swing backwards and upwardly in response to the impact of the bullet with the tabs 123 and the brackets 114 forming a hinge. This allows the shooter to know instantly whether the kill zone has been hit. This may be important as a shooter may not be allowed to advance until a given number of hits are made to a kill zone. Thus, for example, a shooter may not be allowed to advance until he or she has shot each of the targets 122. The shooter is able to instantly tell if each shot hit the appropriate target 122 by the swinging of the target 122, and when she can proceed to the next target.

As will be discussed in more detail below, this interaction between the tabs 123 and the slotted brackets 114 allows the target 122 to easily move, but may also limit movement to contain the "reset" time—i.e., the time between hitting the target and when the target is once again ready to be hit. The interaction between the tabs 123 and the slotted brackets may also allow the target 122 to hang at a predetermined angle relative to the shooter, to hang at a predetermined angle relative to the blocking plate 10, and/or to swing through a predetermined degree of motion when struck with a bullet.

Figure 5:
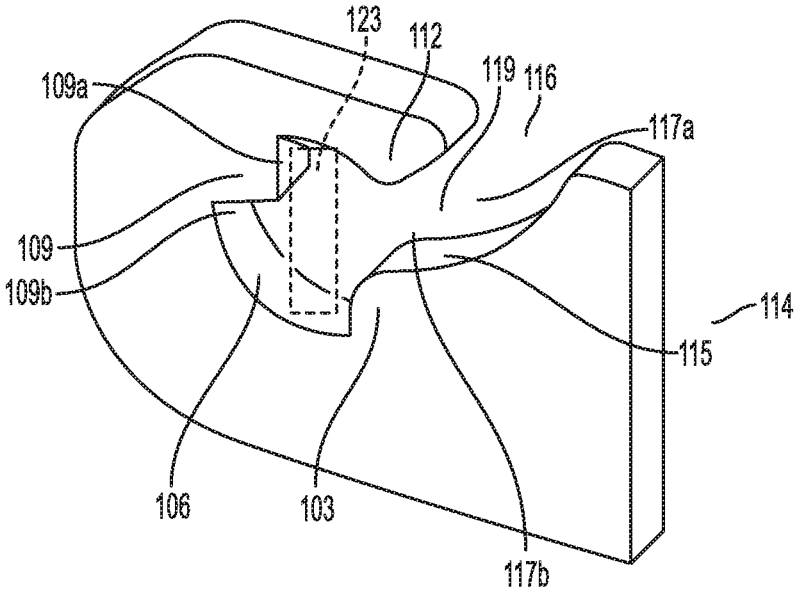
FIG. 5 shows an close up view of one embodiment of a slotted bracket in accordance with the present disclosure.

FIG. 5 is a close up view of a slotted bracket, generally indicated at 114, in which is formed a shaped slot 115, which is adapted to retain the tabs 123 (shown in dashed lines) of a target 122 (FIGS. 1-2), even when the target is struck with a bullet. In some embodiments, slotted bracket 114 includes a shaped slot 115 extending from an opening 116 in the bracket. The shaped slot 115 may include a channel having a vertical portion 117*a* and a horizontal portion 117*b* which leads from the opening 116 to a rotational pocket 106 in which the tab 123 can rotate. In one embodiment, the rotational pocket 106 is formed by two or more projections 109 and 103 so as to leave two generally quarter-circle shaped areas in which the tab rotates so that the tab rotates less than 360 degrees, and typically between about 80 and 100 degrees.

The rotational pocket 106 may be defined by a wall formed by the bracket 114. The wall may be smoothly curved, and may include a retaining projection 109 which may be more sharply angled, such as providing 90 degree surfaces to engage the tab 123 generally vertically on a generally vertical surface 109*a* and to limit rotation of the tab past a generally horizontal orientation with a generally horizontal surface 109*b*. A constriction between the rotational pocket 106 may also be provided by a pair of opposing entry projections 103 and 112 which may be angled or, as in the embodiment of FIG. 5, somewhat curved. The entry projections 103 and 112 constrict the path between the rotational pocket 106 and the channel 117 to require the tab 123 to be in a particular orientation before it can be removed from the rotational pocket 106.

The opening 116 of the shaped slot 115 is preferably disposed forward or rearwardly from the rotational pocket 106 depending on the manner in which the shaped slot 115 is formed in the bracket 114. When a tab 123 of a target 122 is placed into the shaped slot 115, the target 122 can be advanced vertically and then horizontally until the tab 123 sits within the rotational pocket 106. When the target 122 is struck with a bullet, the target will rotate backwardly, until the tab 123 strikes the angled retaining wall or projection 109.

As was mentioned previously, one issue with the configuration shown in FIGS. 1 and 2 is that if the target is at the right angle, the reaction of the target to being struck by a bullet is to climb relative to the bar. In some situations, the target (22) can actually pop out of the hinge pin (30).

In the embodiment shown in FIG. 5, the target 122 cannot entirely leave the shaped slot 115 unless the bottom of the target 122 is rotated rearwardly until the tab 123 extends generally vertically past the projection 103. The tab 123 can then be advanced generally horizontally through the horizontal portion 117*b* of the shaped slot 115, and then generally vertically through the generally vertical portion 117*a* and out the opening 116 in the bracket 114. Because a bullet impact does not impart this type of force, the target 122 generally remains seated in rotational pocket 106. If the impact against target 122 is one of the less common angles which tends to drive the target 122 momentarily out of contact with the rotational pocket 106, tab 123 will only move into the horizontal portion 117*b* and will not allow the target to disassociate from the bracket 114.

It will be appreciated that, in order to facilitate insertion of different types of tabs 123 into shaped slot 115, the entry projection 103 may be rounded or angular. Additionally, the precise placement and shape of the entry projection 103 and the remainder of rotational pocket 106 will modify the angle at which the target 122 hangs, relative to the shooter or the target system 100. The advantage therein is that the target 122 can always be held at an appropriate angle to deflect bullets downward, rather than back at the shooters. This enhances shooter safety, and additionally keeps bullet fragments from scattering as far, making collection easier.

When the target 122 is struck with a bullet, it will only swing until the tab 123 strikes the retaining projection 109. Thus, by modifying the placement of retaining projection 109 or the tabs 123 that engage therewith, a range owner can determine how far back a particular target should swing.

The shaped slot 115 may further be equipped with further means for preventing upwards forces from jolting a plate 122 out of the shaped slot 115. In the embodiment of FIG. 5, guidance part 112 projects over the top of the rotational pocket 106. This has the advantage of securing the tab 123, as well as providing guidance if a user wishes to insert or remove a tab 123.

It will be appreciated that numerous different shaped slots 115 may be formed by varying the structures within the shaped slot 115, such as by selecting an appropriate position for the retaining projection 109 and entry projection 103. By allowing numerous shapes, various functions for the target 122 can be achieved depending on the setting and the desired results.

Figure 6:
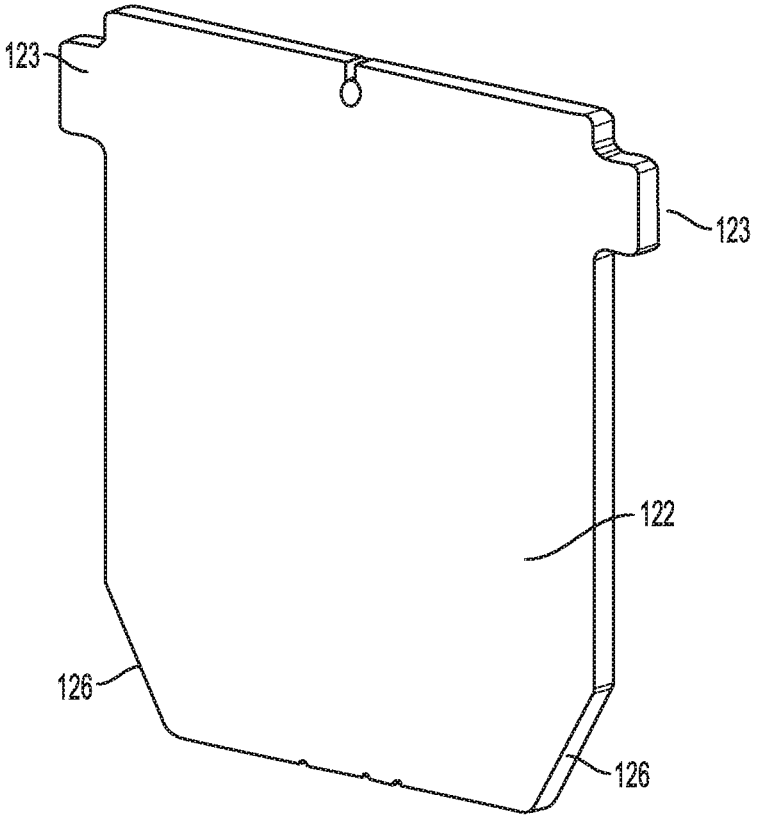
FIG. 6 shows a close up view of one of the targets, including the tabs.

FIG. 6 displays a close up view of a target 122 with tabs 123. The bottom edges 126 of the target 122 may be, for example, rounded or angled. The tabs 123 may be shaped to engage with a shaped slot 115, and may be, for example, rectangular or oval in cross-section, or any shape adapted to engage with a shaped slot 115.

In embodiments comprising two slotted brackets 114 for every target 122, and in which the target 122 hangs between the two slotted brackets 114, most of the targets 122 may have a width less than the distance between the two slotted brackets 1114. This is because the target 122 is most effective when allowed to swing between the slotted brackets 114. However, the width of the target 122 when measured from tab 123 to the opposite tab 123 will be at least the distance between the two slotted brackets 114, in order to permit the tabs 123 to engage with the slotted brackets 114.

Turning now to FIG. 7, there is shown an exploded view of the target system 100, the blocking plate 110, the slotted brackets 114, and the target stand 200. The openings 118 are more clearly visible in FIG. 7. The openings 118 may be of any desired shape, and it will be appreciated that the shape need not be symmetrical, nor does the opening need to be placed in the center of the blocking plate 110—indeed, the openings 118 may extend through the edges of the blocking plate.

The openings 118 may also be elongated in order to account for any angle of the target system 100. That is, if the target stand 200 holds the target system 100 at a 15-degree angle towards the shooter, the top of each opening 118 will be a little closer to the shooter than the bottom of each opening. Thus, if the shooter wishes to shoot at an object that appears at a distance to be a square, the opening 118 must be slightly rectangular. The advantage of this modification is that a shooter may take aim at a regularly-shaped target, even as the safety of the target system 100 is improved.

Figure 8:
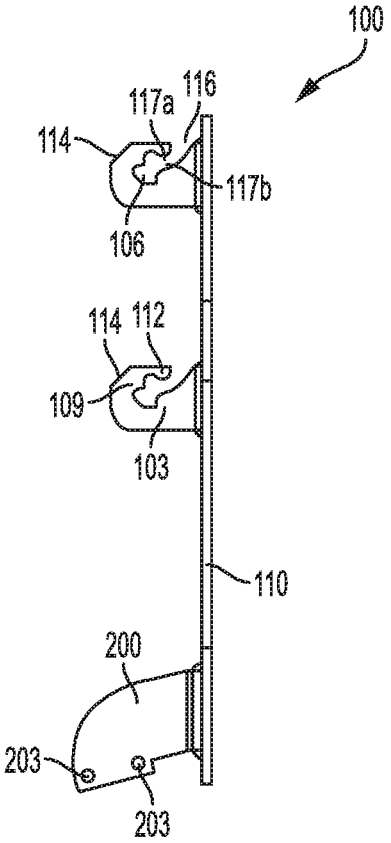
FIG. 8 shows a side view of the target system.

Turning now to FIG. 8, there is shown a side view of the target system, generally indicated at 100, comprising the blocking plate 110, the slotted brackets 114 without targets attached, and the target stand 200. The target stand 200 may be, for example, riveted to the ground with rivets, bolts, welding, or any other attachment means known in the art. The target stand 200 may be adapted for mounting on any surface, including but not limited to a mobile track, a trolley, rails, or stationary surfaces.

The target stand 200 may be tilted, as in the embodiment of FIG. 8, so that when the target system 100 is installed it leans towards the shooter, thereby deflecting any stray bullets downward. The target stand may also be flat, so that when the target system 100 is installed, it stands in an upright position relative to the shooter, to provide a more pleasing target when lighting is poorly angled for shooting at an inclined target.

When the target system 100 is installed so as to be upright relative to the shooter, it may be beneficial to construct the slotted brackets 114 in such a way that the target 122 hangs at an angle relative to the shooter, by selecting an appropriate position for the retaining projection 109 and entry projection 103.

Thus there is disclosed a target system and methods of using the same. It will be appreciated that numerous modifications may be made without departing from the scope and spirit of this disclosure. The appended claims are intended to cover such modifications.

What is claimed is:

1. A bracket for holding a target, the bracket having a channel formed therein, the channel having an opening for inserting a tab of the target, a rotational pocket for holding the tab and allowing the tab to rotate less than 360 degrees while the tab remains in the rotational pocket, and the channel connecting the opening to the rotational pocket and wherein the bracket has a top end and front end and wherein the channel forms an opening at a top end of the bracket and extends downwardly and rearwardly away from the top end and the front end.

2. The bracket according to claim 1, wherein the rotational pocket has a rounded portion and a projection extending into the pocket.

3. A target system including a bracket according to claim 1, and further comprising a target having an elongate tab, the elongate tab being slidable into and out of the rotational pocket.

4. The target system of claim 3, wherein the target system includes two brackets in accordance with claim 1, and wherein the two brackets are disposed in parallel.

5. The target system of claim 4, wherein the target includes two elongate tabs, one tab being disposed in the rotational pocket of one bracket and another tab disposed in the rotational pocket of another bracket.

6. The target system of claim 5, wherein the tabs are rectangular in cross section.

7. The target system of claim 5, wherein the brackets are attached to a blocking plate having a hole formed therein and therein the brackets are disposed adjacent the hole.

8. A bracket for holding a target, the bracket having a channel formed therein, the channel having an opening for inserting a tab of the target, a rotational pocket for holding the tab and allowing the tab to rotate less than 360 degrees while the tab remains in the rotational pocket, and the channel connecting the opening to the rotational pocket and wherein an entry projection extends into the channel adjacent the rotational pocket to reduce the width of the channel.

9. The bracket according to claim 8, wherein a second entry projection extends into the channel adjacent the rotational pocket.

10. A bracket for holding a target, the bracket having a channel formed therein, the channel having an opening for inserting a tab of the target, a rotational pocket for holding the tab and allowing the tab to rotate less than 360 degrees while the tab remains in the rotational pocket, and the channel connecting the opening to the rotational pocket wherein the channel includes an arcuate surface.

* * * * *